US005890294A

United States Patent [19]

Keklak et al.

[11] Patent Number: 5,890,294

[45] Date of Patent: Apr. 6, 1999

[54] LOCKING SAFETY UTILITY KNIFE

[75] Inventors: Ronald Keklak, Amston, Conn.; Michael V. Couture, South Hadley, Mass.

[73] Assignee: P.S.I., Inc., South Hadley, Mass.

[21] Appl. No.: 788,303

[22] Filed: Jan. 24, 1997

[51] Int. Cl.[6] ..... B26D 1/10

[52] U.S. Cl. ..... 30/125; 30/161

[58] Field of Search ..... 30/161, 162, 160, 30/125, 334, 337, 335, 536

[56] References Cited

U.S. PATENT DOCUMENTS

| | | | |
|---|---|---|---|
| 1,756,439 | 4/1930 | Schick | 30/536 |
| 3,448,518 | 6/1969 | Sklar . | |
| 4,277,888 | 7/1981 | Szabo . | |
| 4,683,656 | 8/1987 | Peyrot et al. | 30/162 |
| 4,713,885 | 12/1987 | Keklak et al. | 30/162 |
| 4,761,882 | 8/1988 | Silverstein | 30/162 |
| 4,823,463 | 4/1989 | Lemaire . | |
| 4,949,458 | 8/1990 | Davis et al. . | |
| 4,953,293 | 9/1990 | Sterlacci . | |
| 5,303,474 | 4/1994 | Keklak et al. | 30/162 |
| 5,426,855 | 6/1995 | Keklak et al. | 30/162 |

*Primary Examiner*—Douglas D. Watts
*Attorney, Agent, or Firm*—Shoemaker and Mattare, Ltd.

[57] ABSTRACT

A locking safety utility knife includes a body and an operating lever that is squeezed to deploy a retractable cutting blade from within the body. The blade can be locked in its retracted position by means of a ratchet-like mechanism including a pawl which is released by manipulating a cam operator. The pawl engages teeth formed on the outside of a door which closes the rear of a compartment formed in the operating handle to house spare blades, or a blade cartridge.

10 Claims, 11 Drawing Sheets

LOCKING SAFETY UTILITY KNIFE

BACKGROUND OF THE INVENTION

This invention relates to the art of cutting and more particularly to a locking safety utility knife.

In a standard utility knife, the blade is fixed within a body made in two halves held together by a screw. The blade may be replaced when dull by separating the halves and replacing or reversing the blade. Some knife bodies house extra blades as well.

Other knives have been proposed in which the blade can be moved fore and aft with respect to the body of the tool by various means, such as by turning a screw, or by squeezing an operating lever which advances the blade against the action of a retracting spring. In a prior patent, we provided a utility knife of the type having an operating lever with an adjusting screw which determined how far out of the handle the blade could extend when the lever was squeezed.

The present invention provides an improved mechanism for locking the blade in its variable retracted position, to prevent blade deployment until the locking mechanism is manually deactivated.

SUMMARY OF THE INVENTION

An object of the invention is to improve the safety of a utility knife having variable blade extension, by locking the operating lever of the knife in its blade-retracted position, whatever the adjustment of the blade extension mechanism.

A related object is to produce an audible sound indicative of blade locking.

Another object is to permit the locking mechanism to be momentarily overridden by the user.

A related object is to provide the user a means of disabling the locking feature when desired.

A further object of the invention is to provide a knife with a storage compartment in the operating lever, and means for dispensing fresh blades from the compartment.

A further related object is to provide a blade cartridge which may be used as a perfect replacement for loose blades in the storage compartment.

These and other objects are attained by a locking safety utility knife having a body and an operating lever that is squeezed to deploy a retractable cutting blade from within the body. The blade can be locked in its retracted position by means of a ratchet-like mechanism including a pawl which can be released by manipulating a bistable cam operator. The pawl engages teeth formed, preferably, on the outside of a door which closes the rear of a compartment formed in the operating handle to house spare blades, or a blade cartridge.

BRIEF DESCRIPTION OF THE DRAWINGS

In the accompanying drawings.

DESCRIPTION OF THE PREFERRED EMBODIMENT

Figure 1:
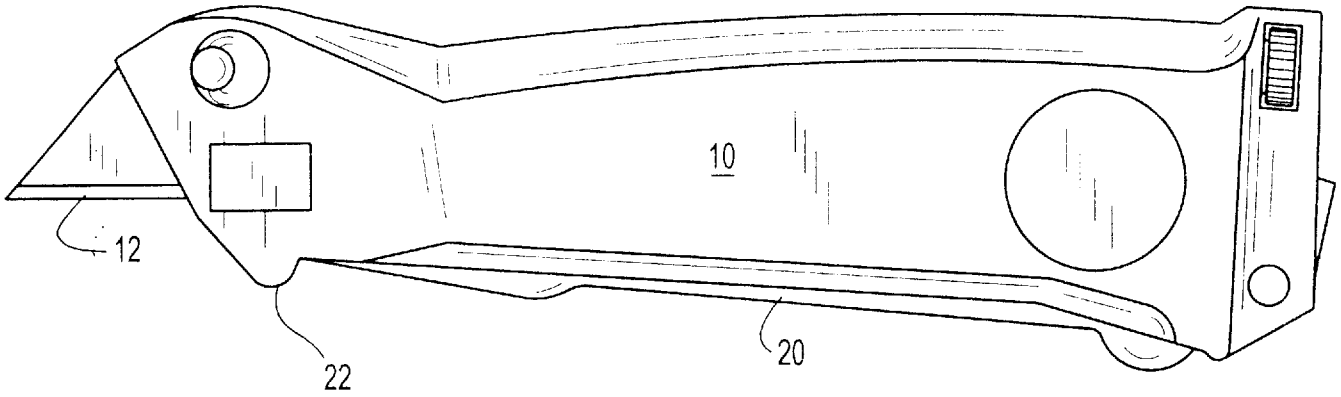
FIG. 1 is a left side elevation of a locking safety utility knife embodying the invention, with the blade deployed.
Figure 2:
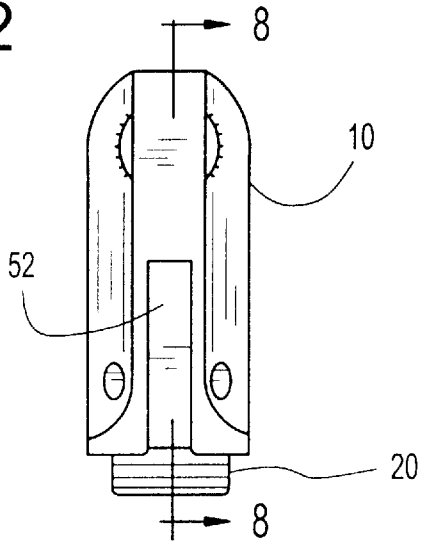
FIG. 2 is a rear elevation thereof.
Figure 3:
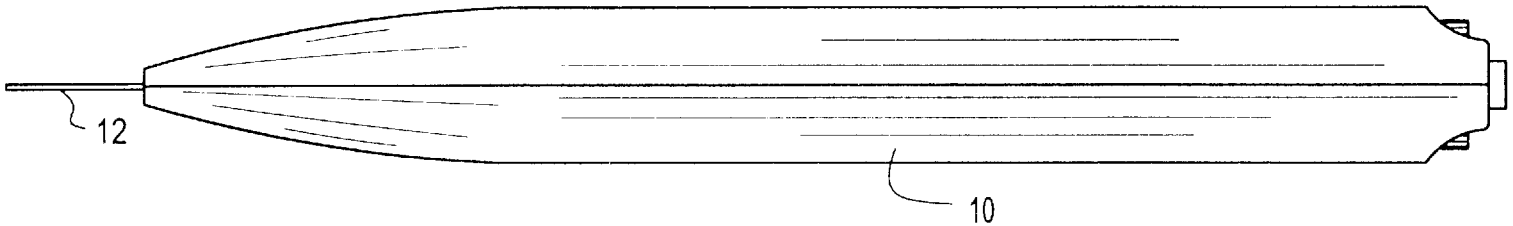
FIG. 3 is a top plan view thereof.

A locking safety utility knife embodying the invention includes a body 10 (FIGS. 1–6) having a hollow interior configured to receive a cutting blade 12, which is normally retracted within the interior, but can be extended partially from the knife by operating a lever 20 which is pivotally connected to the body, for example by a flexible living hinge 22. A mechanism for connecting the lever to the blade is disclosed in U.S. Pat. No. 5,303,474, the specification of which is incorporated by reference. The lower position of the lever (FIG. 4) corresponds to the retracted position of the blade, and the upper position (FIG. 1) corresponds to the deployed or extended position of the blade. The distance that the blade extends from the body when the lever is squeezed to its uppermost position may be adjusted by means of a thumb wheel at the rear of the tool, as described in U.S. Pat. No. 5,426,855, the specification of which is also incorporated by reference.

The more the lever 20 is moved upward into the body by squeezing it, the farther the blade 12 extends from the front of the body 10, unless the blade extension has already been adjusted to zero, in which case the stroke of the lever is zero.

The lowermost position of the lever is a function of the thumb wheel adjustment: the greater the maximum extension of the blade, the further downward the lever has to move to the fully retracted blade position.

Because the blade-retracted position of the lever is variable, it is not possible to lock the lever at just one position. We have therefore provided a ratchet-type locking mechanism at the rear of the lever, to prevent inadvertent blade deployment, regardless of the setting of the thumb wheel. No matter what the position of the lever is when the blade is retracted, that position can be maintained by activating the locking mechanism described below.

Figure 7:
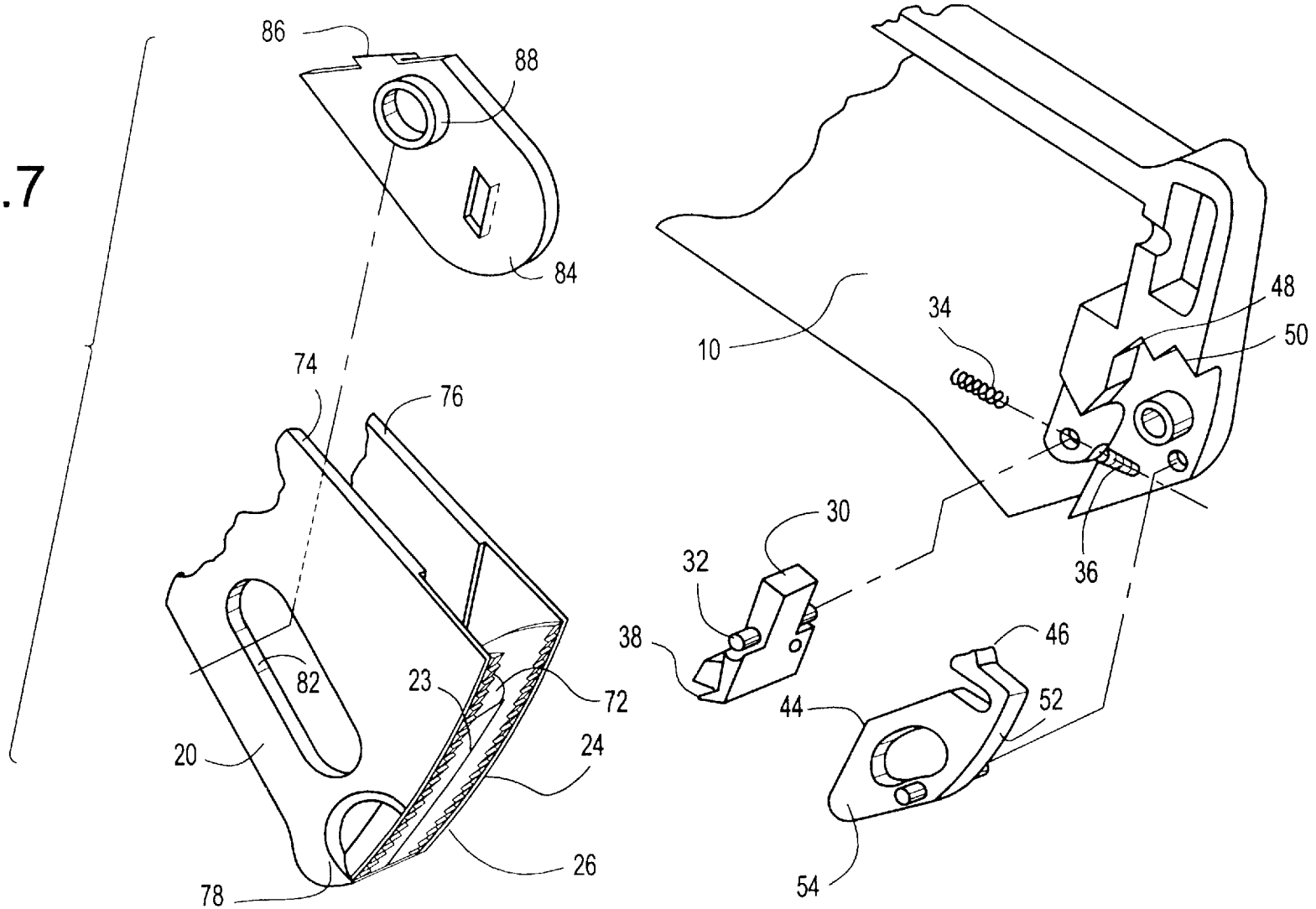
FIG. 7 is an exploded isometric view showing details at the rear of the knife.

The locking mechanism (FIG. 7) comprises a pair of arcuate racks 23,24 having upwardly-raked teeth or serrations on a door element 26 at the rear of the lever, and a pawl 30 for engaging the teeth. When the pawl is engaged, upward movement of the lever is prevented.

The pawl (FIG. 7) is preferably pivoted on a pin 32 set in holes in the halves of the body of the knife. A spring 34, set in a slot which forms a blind hole 36 in the body, urges the pawl tip 38 forward toward the teeth.

Figure 8:
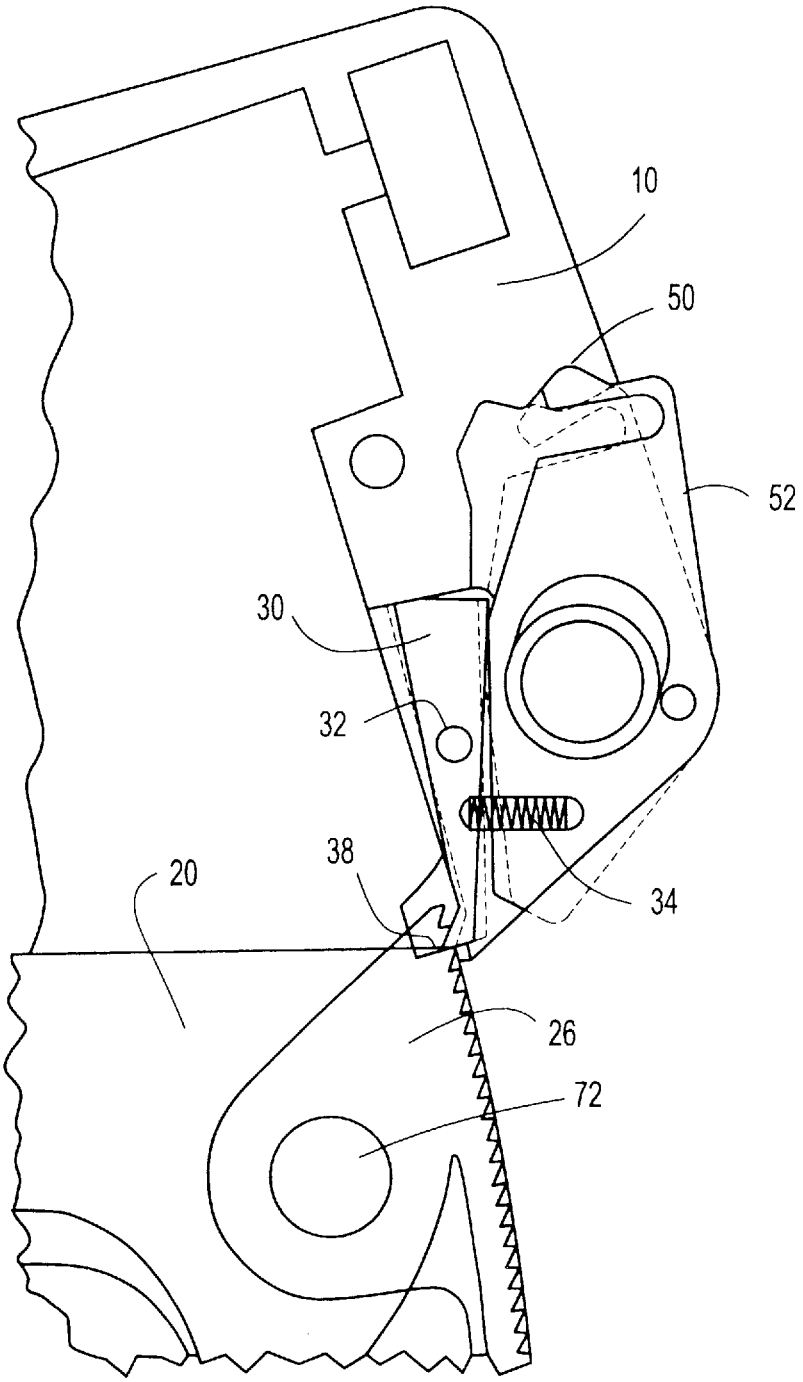
FIG. 8 is a sectional view taken on the line 8—8 in FIG. 2, with the lever locked in position by a pawl.
Figure 9:
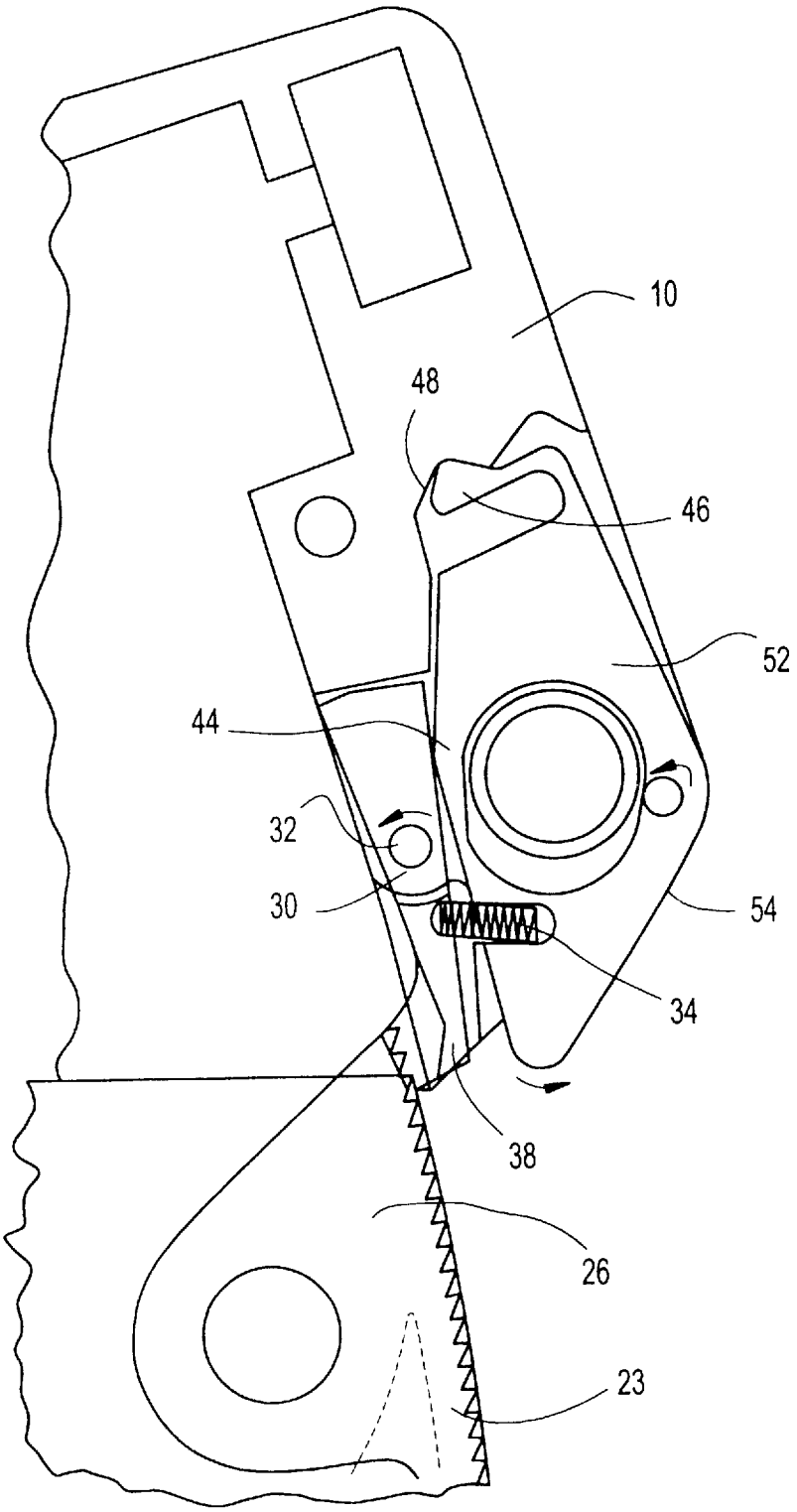
FIG. 9 is a view like FIG. 8, showing the pawl disengaged.

The pawl is controlled by a cam 44 (FIG. 7) having two stable positions. Each position is defined by the interaction of a spring finger 46 at the top of the cam, and one of a pair of correspondingly shaped detents 48,50 in the tool body. The pawl is held in a disengaged position by the cam when the finger is in the forward detent (FIG. 9); the cam releases the pawl, so that the spring drives the pawl's tip forward, when the finger is in the rearward detent (FIG. 8). The user can toggle the cam by depressing its rearward or lower wing 52,54, whichever one is projecting from the body at the time.

Figure 4:
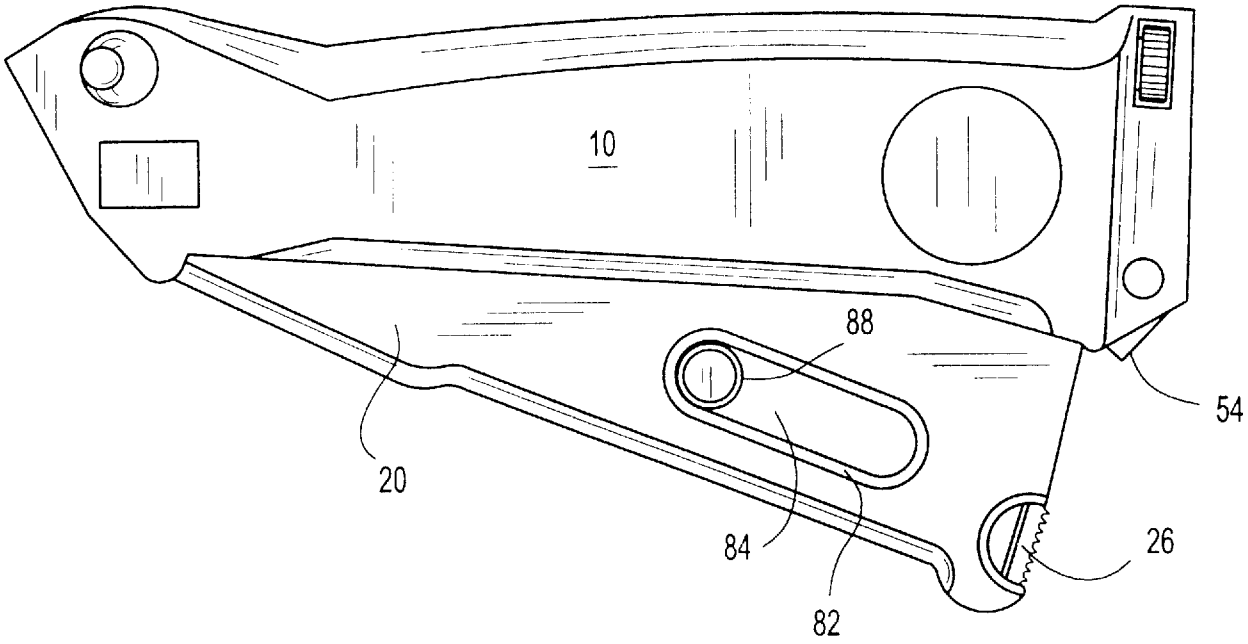
FIG. 4 is a view like FIG. 1, showing the blade retracted.
Figure 5:
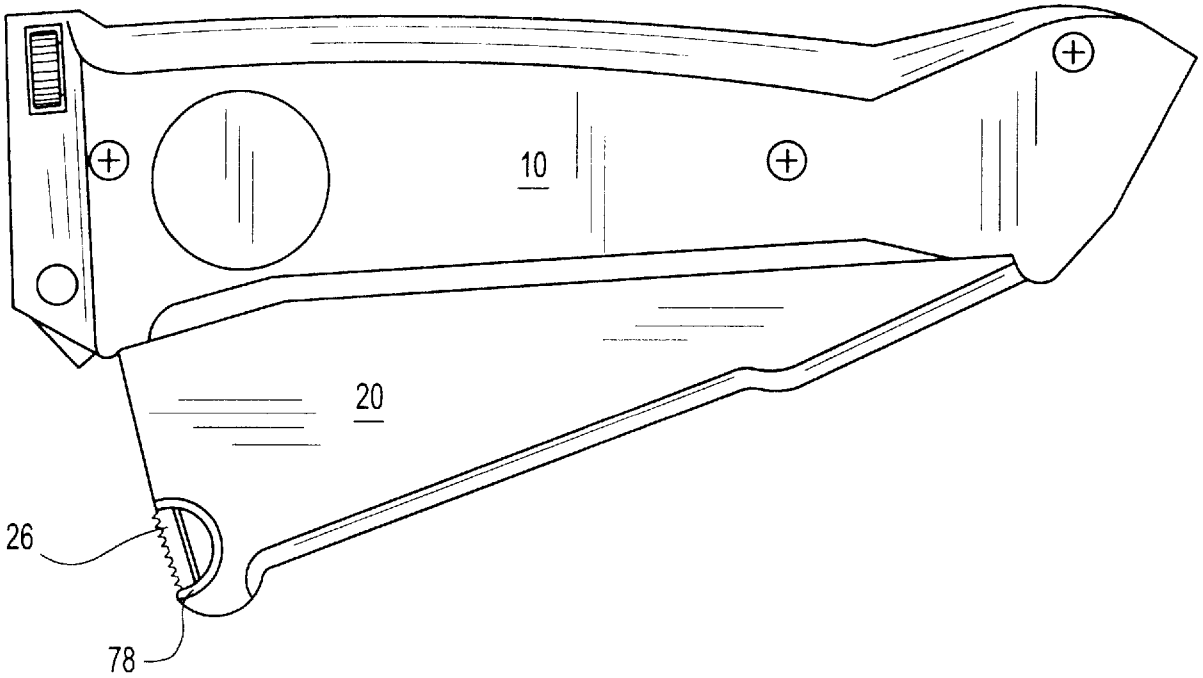
FIG. 5 is a right side elevation thereof.

When the pawl is engaged with the teeth on the door element, the lever can move only downward, so that the blade cannot be further extended. When hand pressure on the lever is released, a biasing spring (not shown) within the tool pushes the lever downward with sufficient force to overcome the spring force on the pawl, to the limit of the lever's movement, as depicted in FIG. 4. As this happens, the pawl, riding over the upwardly-raked teeth, produces an audible noise confirming that the lock is engaged. If the user has not engaged the pawl properly, the silence upon lever release alerts him that the knife still needs to be locked.

As an added convenience, the cam can be moved partly away from its locking position momentarily by pressing the rear of the tool against a surface, moving the cam about half-way to its release position, as illustrated by broken lines in FIG. 8. This movement is sufficient to disengage the pawl tip from the serrations, enabling the user to squeeze the lever and extend the blade, but not sufficient to move the spring finger out of the rearward detent 50. As soon as pressure is released, the cam and pawl return to the positions illustrated by solid lines in FIG. 8. This way, the user can extend the cutting blade, without moving the cam all the way to the unlocked position shown in FIG. 9.

Figure 10:
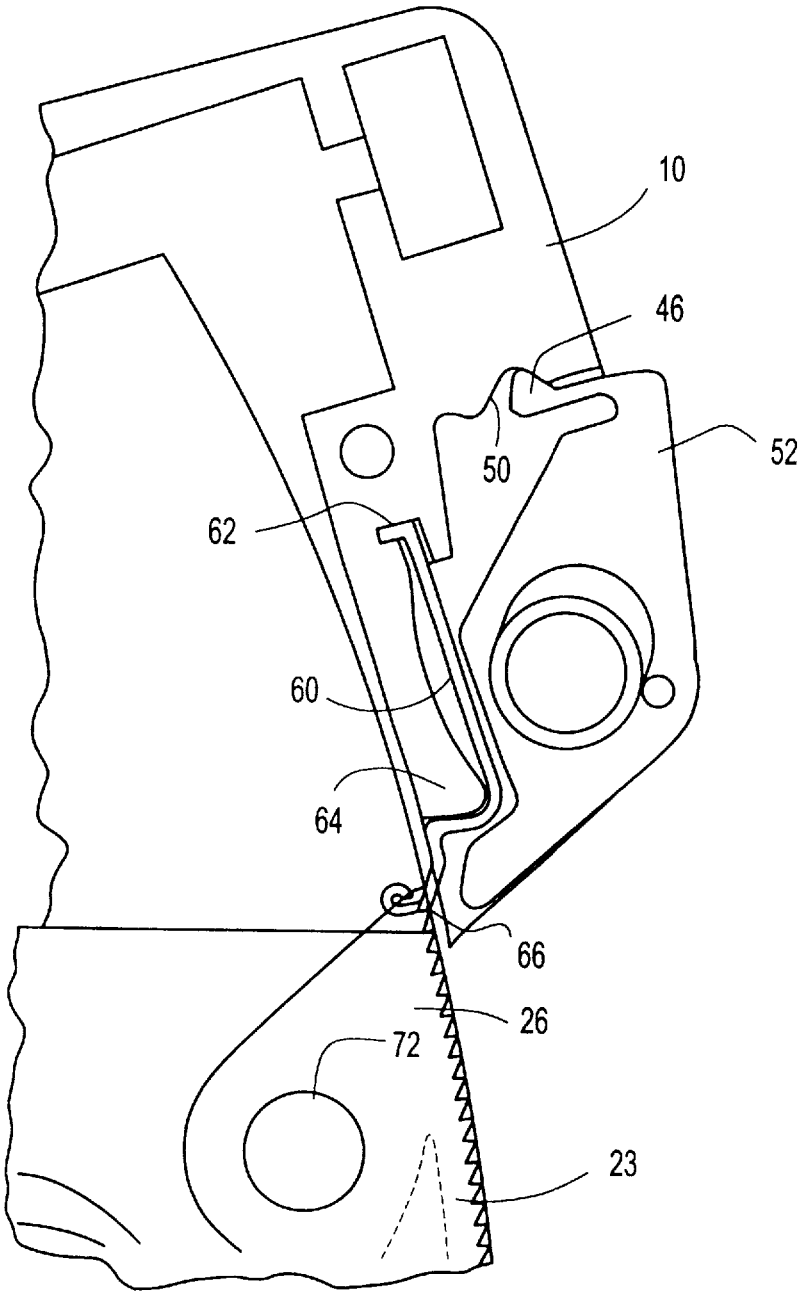
FIGS. 10 and 11 are views like FIGS. 8 and 9 respectively, showing an alternative form of the pawl.
Figure 11:
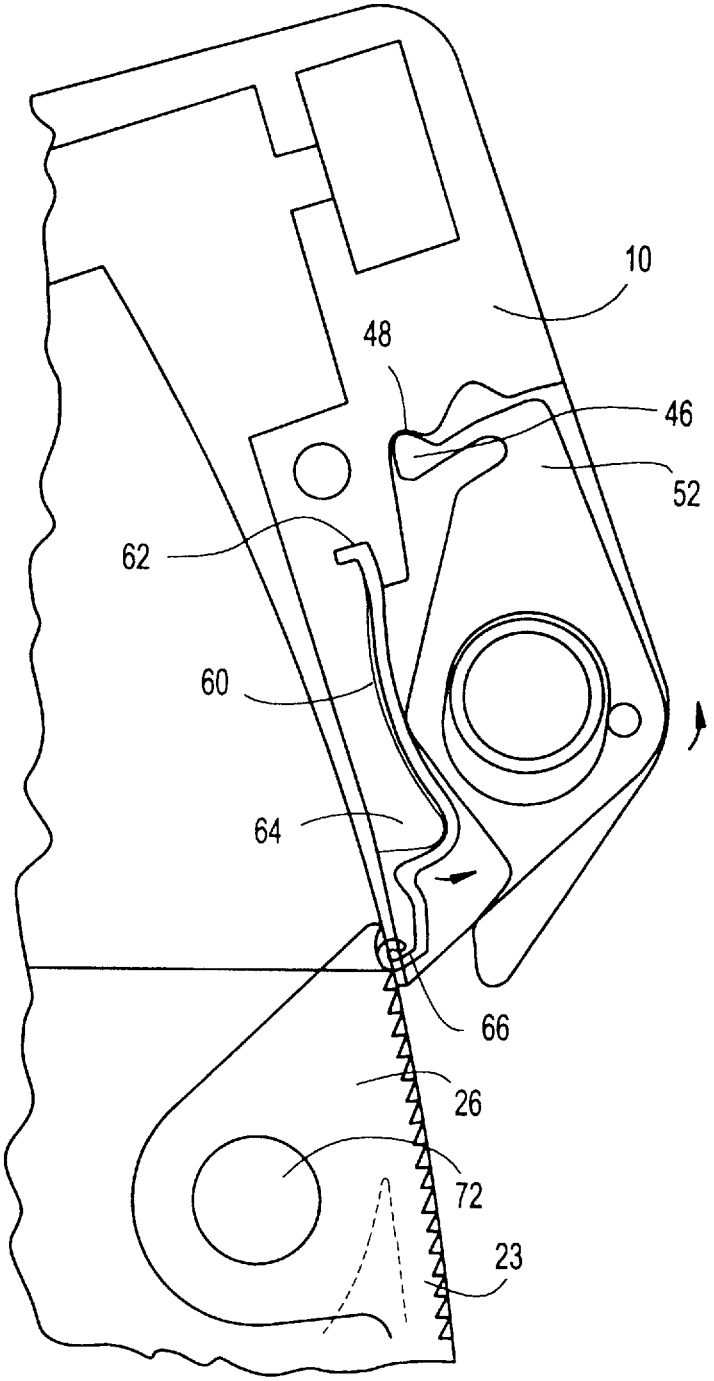

An alternative form of the pawl is shown in FIGS. 10 and 11. Here, the pawl is a flexible metal strip 60, whose upper end 62 is anchored in a recess in the body, and whose lower end passes tightly around an abutment 64 molded in the body. When the cam is pressed forward against the center of the strip, the strip flexes (FIG. 11), causing the lower end of the strip to move about the abutment 64, withdrawing the pawl tip from the teeth on the door.

Figure 6:
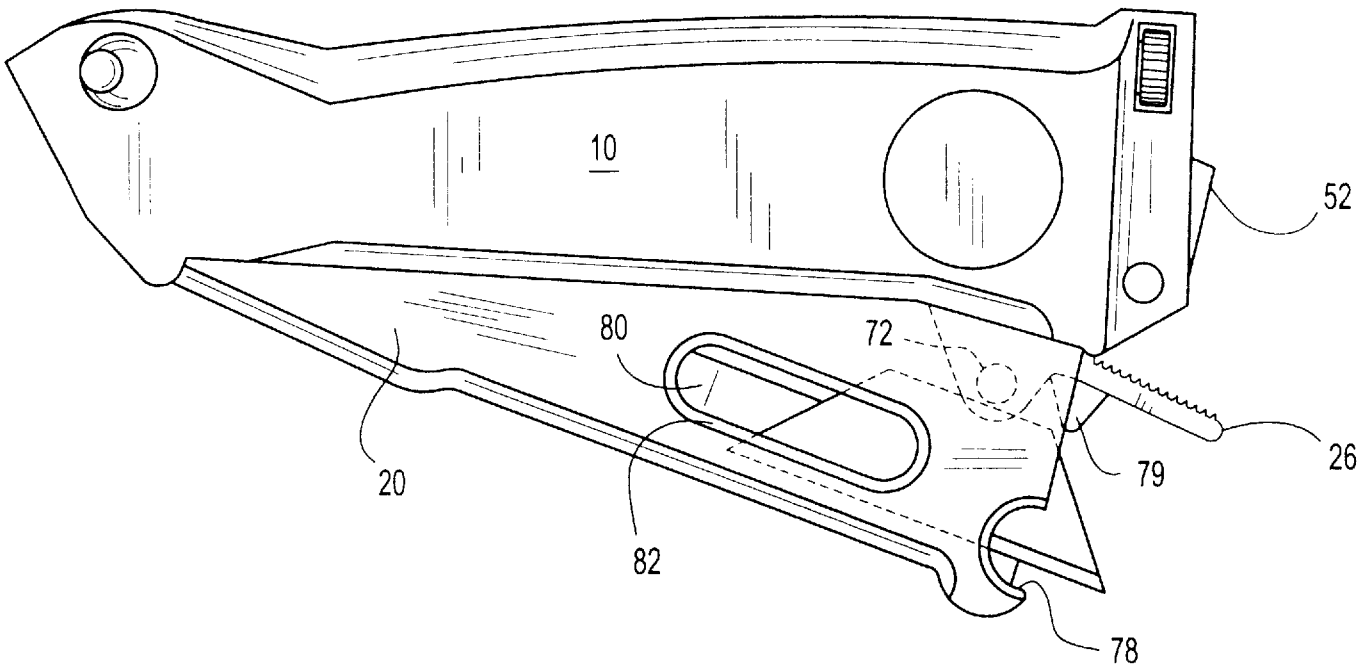
FIG. 6 is a view like FIG. 4, showing a blade being removed from a storage compartment in the operating lever.

It should be understood that variations from the structure described above are possible. It may not be necessary, for example, to provide two rows of teeth on the lever: one might do. And it may be possible to form the teeth directly on the lever, rather than making them on a separate piece. In the preferred embodiment, however, two rows of fine-pitch teeth are cut on the metal door element 26. The door element (FIG. 7) is mounted for pivoting about a pin 72 molded in the lever, between two walls 74,76 defining a blade storage compartment. The door can be pivoted upward and rearward, as shown in FIG. 6, by grasping the element near its bottom, where recesses 78 are formed in the sides of the lever, at the rear, to accommodate the fingers. The door must be closed, sealing off the compartment formed between the sides of the lever, for the lever to operate. As the door is closed, the pusher element 79 formed on the rear of the door engages any blades which may be partially extending from the compartment, forcing them fully into the compartment as the door is closed.

Figure 13:
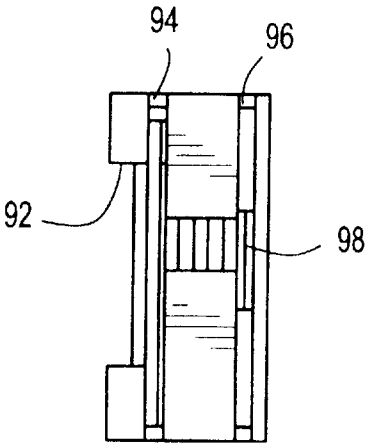
FIGS. 12, 13 and 14 are side, rear and top views respectively of a blade cartridge which may be inserted into the handle in lieu of loose blades.
Figure 12:
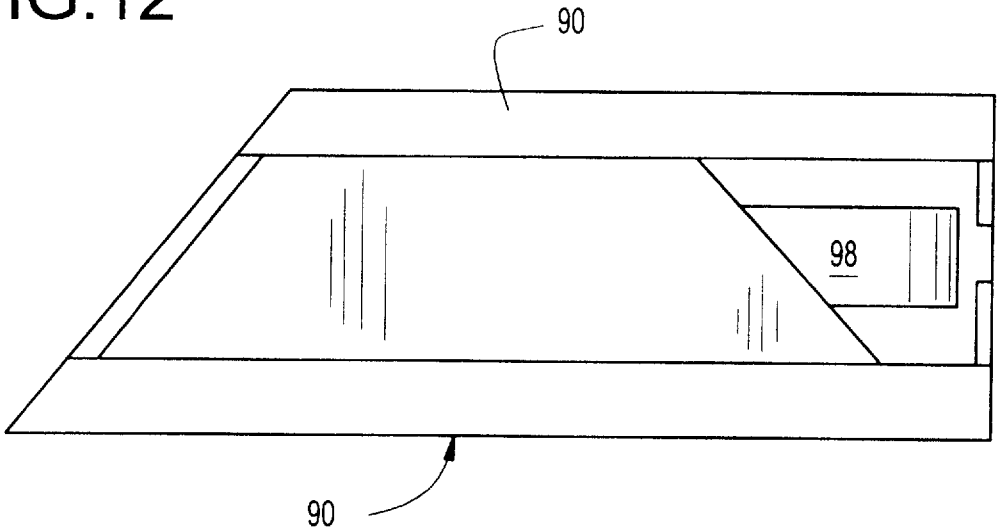
Figure 14:
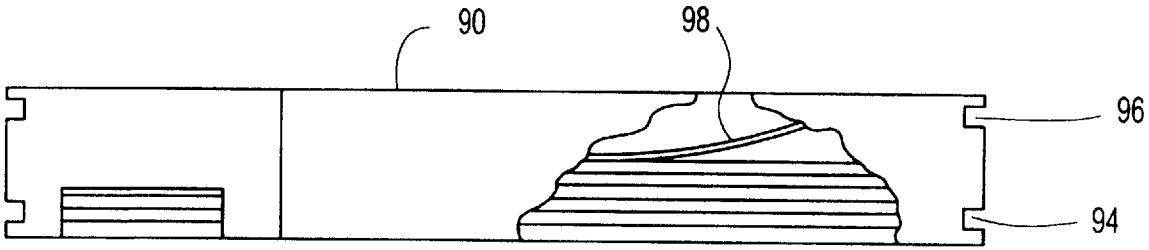

Now, the compartment is shaped to receive a plurality of blades, either loose in a stack (FIG. 6) or in a cartridge (FIGS. 12–14). A leaf spring 80 secured within the compartment at its front end has more than sufficient bow to reach the left wall of the compartment. A number of spare blades can be pushed into the compartment side-by-side. The leftmost blade is always accessible and visible through the oval window 82 in the left wall of the compartment. One removes a blade by drawing it rearward with a finger through the window. Optionally, an ejector (FIG. 7) 84 may be included, mounted for reciprocating motion in the window 82, and having means such as a tab 86 for engaging the blades, to protect the fingers. A hollow button or collar 88 extends leftward through the window, limiting the ejector's motion, and enabling the user to see the leftmost blade in the compartment.

We prefer a blade cartridge to loose blades. A suitable blade cartridge 90 is illustrated in FIGS. 12–14. It is generally a right trapezoidal prism whose front wall is inclined about parallel to the front edge of a utility knife blade, and whose rear wall is perpendicular to the parallel top and bottom walls. The left wall has a substantial opening or gap 92 so that the leftmost blade can be engaged with the finger to push it out of the cartridge, through a slot 94 at the left of the rear wall.

A slot 96 on the right side allows one to insert spent blades.

A leaf spring 98 contained within the cartridge, and secured against the right wall, constantly biases the stack of blades to the left.

In use, when the knife's blade becomes dull, one can remove it, insert it into the cartridge at the right, and remove a new blade from the left. The cartridge may be replaced when all the blades have been used.

When the cartridge is placed into the compartment, the compartment's own leaf spring 80 presses the cartridge leftward against the left wall, holding it secure in the compartment. The blades within the cartridge are pressed to the side only by the cartridge leaf spring 98.

It may be observed (FIG. 13) that, until the cartridge is placed in the compartment, the leftmost blade is offset about half a blade width to the left of the center plane of the slot 94. This prevents the blade from being dislodged from the cartridge accidentally.

The ejector protrudes into the gap in the cartridge sufficiently far to displace the blade stack rightward, when the cartridge is inserted, about half a blade width, so that the leftmost blade now becomes aligned with the slot 94, and can be driven rearward the by tab on the ejector when the ejector button is drawn rearward with the thumb. On its return stroke, the tab rides over the new leftmost blade in the stack.

We prefer to make the last (rightmost) blade in the cartridge visibly distinct from the others, for example, a different color, so that one can see, by looking through the button or the window, when one is about to remove the last fresh blade. Alternatively, a visibly distinct mock blade or separator could be the last item in the stack, separating fresh blades from spent blades that have been inserted at the right of the stack.

It should be understood that "right" and "left" as used above apply only to the preferred tool illustrated, and that a mirror image of the tool would be within the scope of this invention. Also, it should be understood that any materials or dimensions specified are intended to assist others to make and use the knife, and not as limitations on the invention.

Since the invention is subject to modifications and variations, it is intended that the foregoing description and the accompanying drawings shall be interpreted as only illustrative of the invention defined by the following claims.

I claim:

1. In a safety utility knife comprising a body having a hollow interior, a blade normally retracted within said interior, said blade being movable to an extended position partially extending from the knife, an operating lever pivotally connected to the body, and connected to the blade, said lever being movable between a first position corresponding to the retracted position of the blade, and a second position corresponding to the extended position of the blade, the improvement comprising, in combination therewith, a series of teeth on a portion of the lever, and a pawl for engaging any of said teeth, the teeth and the pawl being configured to permit the lever to move downward with respect to the body to retract the blade, but not upward, and to produce a sound indicative of pawl engagement as the lever moves downward, and a manually operable means for releasing the pawl from engagement with said teeth.

2. The invention of claim 1, wherein the releasing means comprises a cam mounted for movement with respect to said pawl, said cam having a first position in which it does not prevent the pawl from engaging the teeth, and a second position in which it does prevent the pawl from engaging said teeth.

3. The invention of claim 2, wherein the cam is bistable, having a spring finger which seats in either of two detents provided in said body, one detent being engaged by the spring finger in said first position, and the second detent being engaged by the spring finger in said second position.

4. The invention of claim 3, wherein the pawl pivots on a pin set in the housing.

5. The invention of claim 3, wherein the pawl is a flexible member which flexes between two abutments in the body, and an end of the member extends below a lower of said abutments, for engaging any one of said teeth on said lever.

6. The invention of claim 3, wherein the cam has a pair of wings arranged so that one or the other protrudes from the rear of the body in either of said first and second positions, and wherein one of the wings is flush with the body in a position of the cam intermediate said first and second positions, whereby one can momentarily release the pawl by pressing the rear of the body against a flat surface.

7. In a safety utility knife comprising a body having a hollow interior, a blade normally retracted within said interior, said blade being movable to an extended position partially extending from the knife, an operating lever pivotally connected to the body, and connected to the blade, said lever being movable between a first position corresponding to the retracted position of the blade, and an second position corresponding to the extended position of the blade, the improvement wherein the lever contains a compartment for receiving spare blades and used blades, said compartment containing a first leaf spring for bearing against said blades so as to bias them against one wall of the compartment, said one wall having a window through which one can slide a blade out of the compartment and further comprising a door at the rear of the compartment for closing the compartment, said door comprising a blade pusher for pushing blades completely into the compartment as the door is closed.

8. The invention of claim 7, further comprising a blade cartridge insertable into said compartment, said cartridge comprising plural walls including a pair of side walls and a rear wall, one of said side walls having an opening through which blades in the cartridge may be manipulated, and the rear wall having one slot through which blades can be removed from the cartridge and another slot through which blades may be inserted into the cartridge for temporary safe storage.

9. The invention of claim 8, further comprising a second leaf spring, fixed within the cartridge, for biasing blades in the cartridge toward said first slot, while said first leaf spring holds the cartridge in place within the compartment.

10. The invention of claim 9, further comprising a plurality of fresh blades, one of said blades being color coded to indicate to the user when there is only one blade left.

* * * * *